United States Patent [19]

Altherr et al.

[11] Patent Number: 4,700,853

[45] Date of Patent: Oct. 20, 1987

[54] SLACKLESS RAILWAY COUPLER CONNECTION

[75] Inventors: Russell G. Altherr, Munster, Ind.; John W. Kaim, Chicago, Ill.

[73] Assignee: Amsted Industries Incorporated, Chicago, Ill.

[21] Appl. No.: 691,077

[22] Filed: Jan. 14, 1985

[51] Int. Cl.[4] ..... B61G 7/10

[52] U.S. Cl. ..... 213/50; 213/62 R

[58] Field of Search ..... 213/50, 50.5, 51, 61, 213/62 R, 62 A, 54, 56, 57, 64, 67 R, 69, 72

[56] References Cited

U.S. PATENT DOCUMENTS

| | | | |
|---|---|---|---|
| 1,859,699 | 5/1932 | Haseltine | 213/67 R X |
| 3,716,146 | 2/1973 | Altherr | 213/64 X |
| 4,343,407 | 8/1982 | Murphy | 213/51 |
| 4,456,133 | 6/1984 | Altherr et al. | 213/62 R |
| 4,531,648 | 7/1985 | Paton | 213/50 |
| 4,549,666 | 10/1985 | Altherr et al. | 213/62 A |
| 4,573,594 | 3/1986 | Kunst et al. | 213/51 |

*Primary Examiner*—Randolph A. Reese

*Attorney, Agent, or Firm*—Charles E. Bouton; Edward J. Brosius

[57] ABSTRACT

A railway coupler connection is provided for slackless arrangements wherein spacer lugs are provided between the coupler shank and the sill side castings to restrain lateral movement of the coupler member at about the draw key; and access ports are provided in a pocket casting to facilitate withdrawal of a wedge holding the coupler parts together whereby the parts may be disassembled.

10 Claims, 5 Drawing Figures

SLACKLESS RAILWAY COUPLER CONNECTION

This invention relates to improvements in the shank of a coupler member and associated parts in a slackless railway car connection system, and more specifically involves an improved coupler member with curved side surfaces and improved sill side castings with spacer means for positioning a coupler or drawbar.

THE PRIOR ART

Railway cars are connected together by coupler members, namely couplers or drawbars. Couplers are independent units on each car which interconnect with one another, between adjacent cars, to form a connection. Drawbars are integral units extending between two adjacent cars to form a connection.

In either instance, a shank end of the coupler or drawbar extends into the center sill of a railway car where it is secured to transmit longitudinal forces to the car.

This invention is directed to an improvement in the center sill construction for receiving primarily drawbars, but may also have application to receiving couplers, in a slackless system. By slackless, it is meant that the drawbar (or coupler) is received within the center sill in a manner to minimize longitudinal play or movements. However, because successive railway cars in a train must accommodate relative movement between cars when curves and inclines are negotiated, there must be provision for each car to move in pitch, yaw and roll modes with respect to the coupler member. Moreover, there must be a provision to remove the draft components for repair and replacement of parts and, in connection with drawbar systems, to disconnect connected cars.

In a slackless system, the coupler member is held in a way to eliminate, or minimize, longitudinal movement with respect to the car body. This may be done by providing a tapered wedge between a rear wall of a pocket casting (secured in the center sill) and a follower block which rests against the butt end of the coupler member. The wedge tends to force the follower block away from the pocket casting end wall and firmly against the butt end of the coupler member shank. When cars are being pushed, the longitudinal forces cause compression of the coupler member against the follower, wedge and pocket end wall.

When cars are being pulled, the longitudinal forces tending to separate the drawbar from the pocket casting, are countered by a draft key which is a metal bar that extends laterally of the car center sill through slots in the sidewalls of the center sill and a slot in the shank of the coupler member. In a slackless drawbar system, the drawbar is held tightly between the key bearing block and/or draft key and follower block by operation of the wedge which separates pocket casting and follower block and compresses the follower block against the drawbar to force the latter against the key bearing block and/or draft key. However, the mating faces of the follower block and drawbar are preferably curved to permit the drawbar to pivot slightly both vertically and laterally and to permit the car to roll respecting the drawbar; and the drawbar pivots at the draft key on an arcuate key bearing block interposed between the parts. Examples of slackless coupler systems are shown in Russell G. Altherr U.S. Pat. No. 4,456,133 and copending application Ser. No. 561,873 filed Dec. 15, 1983, now U.S. Pat. No. 4,593,827.

BRIEF SUMMARY OF THE INVENTION

According to the present invention, the end of a coupler member such as a drawbar (or coupler) is restrained against excessive lateral movement within the pocket casting, but, within limits, is allowed to twist and pivot therein; and in a preferred embodiment access is provided in the pocket casting for withdrawing the wedge from between the follower block and pocket end wall to facilitate assembly and disassembly of the slackless drawbar system.

Therefore, it is a principal object of the present invention to provide a slackless coupling connection wherein the coupler member is restrained against lateral movement within a railway car center sill.

Another object of the present invention is to limit lateral movement of a slackless system drawbar coupling by locating spacer means within a railcar center sill to either side of the drawbar.

Still another object of the present invention is to limit lateral movement of a slackless system drawbar coupling by locating guide lugs having contoured surfaces within a railcar center sill to either side of the drawbar and correspondingly shape the drawbar surface to facilitate angling and roll movement of the drawbar.

Yet another object of the present invention is to provide means in a slackless coupling system whereby to withdraw an adjustable part to introduce slack for disassembling the system.

Generally speaking, the present invention involves the placement of contoured spacer means within the center sill to either side of the coupler member and both above and below the draft key slots whereby to prevent lateral movement of the drawbar on the draft key; and in a preferred embodiment also includes access means (or ports) in the pocket casting through which the wedge may be engaged and withdrawn from contact with the follower blocks.

BRIEF DESCRIPTION OF THE DRAWINGS

Further objects and advantages will become apparent upon reading the following detailed description in conjunction with the drawings wherein.

DETAILED DESCRIPTION OF THE INVENTION

Figure 1:
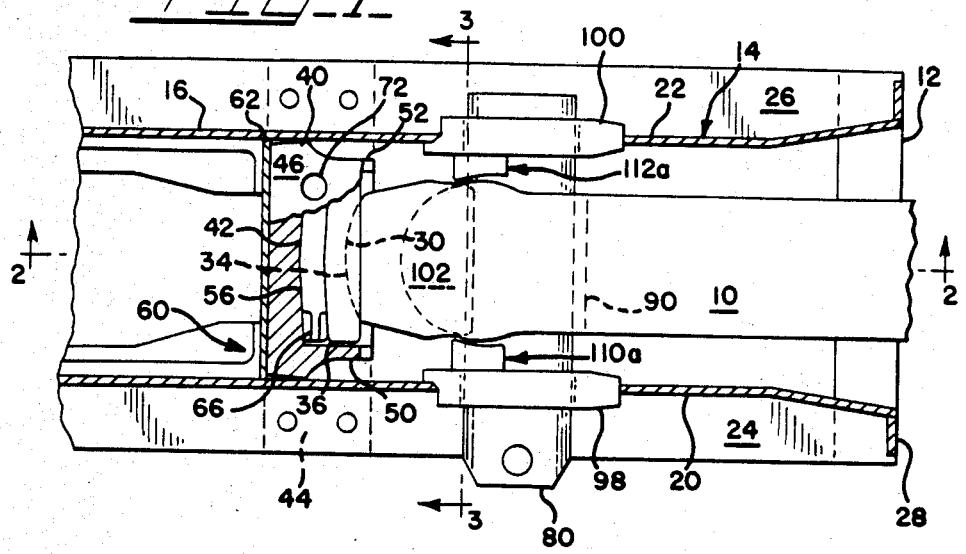
FIG. 1 is a plan view of a preferred embodiment of the invention with certain parts broken away for clarity.

As may be seen in the FIGURES, one end of a coupler member such as drawbar, generally 10 (partially shown), extends within an open end 12 of a center sill, generally 14, which is secured longitudinally beneath a railway car (not shown). The center sill, generally 14, is of standard construction comprising an inverted "U" shaped channel member 16 having top wall 18, side walls 20, 22 and outturned flanges 24, 26 at the lower open bottom. The open end 12 may be framed with a striker flange 28.

Figure 2:
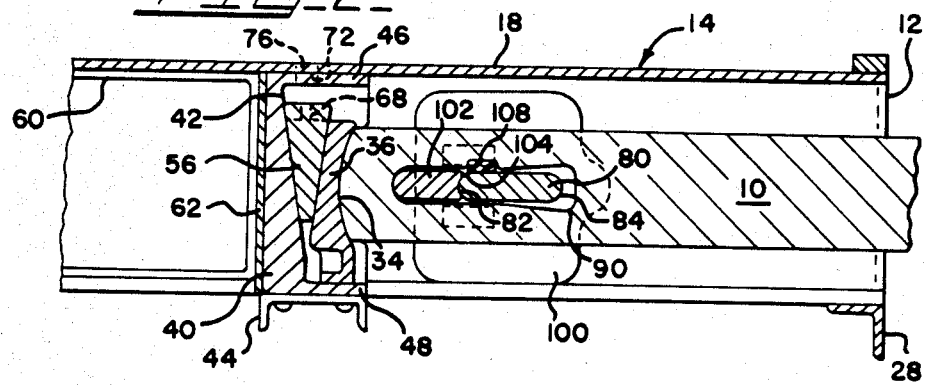
FIG. 2 is a side elevation of the apparatus of FIGURE in partial section taken at line 2—2 in FIG. 1.

A convex butt end 30 of drawbar, generally 10, fits against a matching concave face 34 of a follower block 36 which is held within a pocket casting 40. A vertically tapered wedge 56 is located between the follower block 36 and pocket casting 40 rear wall 42 to remove slack spacing between the sill side casting, draft key, key bearing block, drawbar, follower block and pocket casting components. Usually, the pocket rear wall 42 and the back side of the follower block are sloped, as seen in FIG. 2, to cooperate with the tapered profile of the wedge 56. The pocket casting 40 is mounted crosswise within the center sill channel member 16 upon a support channel 44 which is fastened to the sill flanges 24, 26 by rivets or the like. Also, the pocket casting abuts stop member, generally 60, which is secured within the center sill, generally 14, and may be slightly spaced therefrom by a shim 62 which functions to take up slack slightly and adjustably space the pocket casting 40 and stop 60. It is also possible to movably mount the pocket casting against a cushioned stop member.

Preferrably, the pocket rear wall 42, both faces of wedge 56 and the back side of follower block 36 are angled chevron-like (as may be seen in FIG. 1) to assist alignment of the parts within the cavity formed by the rear wall 42 and top 46 bottom 48 and side walls 50, 52 of the pocket casting 40. This feature is the subject of a copending application of another inventor.

According to the present invention, the wedge 56 may be provided with lifting lugs 66, 68 at the opposite sides and access ports 70, 72 correspondingly located in the top wall 46 of pocket casting 40. Additional corresponding apertures 74, 76 are located in the sill top 18 and an openable trap, or the like (not shown), may be installed in the railway car floor to facilitate vertical withdrawal of the wedge 56 from between the follower block 36 and pocket rear wall 42 and thereby provide sufficient slack to permit disassembly of the drawbar 10 and other draft gear parts.

Drawbar 10 is held within the center sill 14 by a draft key 80, having rounded edges 82, 84, which is extended horizontally through a slot 90 in the drawbar and through key slots 94, 96 provided in sill side castings 98, 100 which are welded in openings provided in the center sill sides 20, 22 respectively. The drawbar slot 90 is arched toward the convex butt end 30 and retains therein a correspondingly contoured arcuate key bearing block 102 which has a concave straight side 104 adapted to receive a convex edge 82 of the draft key 80. As may be also seen in FIG. 2, the slot 90 in the drawbar 10 diverges vertically opposite the drawbar end 30 (although it is possible to similarly diverge the slots 94, 96 in sill side castings 98, 100). The aforedescribed arrangement of draft key, key bearing block and slots permits vertical and horizontal angling movement of the drawbar within the center sill 14 from the concave follower block 36. It being understood that in the described slackless system, the sill side castings 98, 100 and the slots 94, 96 therein, are carefully spaced from the pocket casting 40 in accordance with the dimensions of the drawbar 10, and the distance between its convex end 30 and key slot 90, so that the draft key 80 is urged against the forward end of slots 94, 96 in the sill side castings 98, 100 and against the key bearing block 102 within the drawbar key slot 90. It is further to be understood that the vertical dimensions of the slots permit 4–5 degrees of roll movement of the drawbar 10 within the center sill 14.

There is also a resilient foot member 108 fastened against the center upper surface of the drawbar key slot 90 for the purpose of holding the drawbar 10 upwardly so that the center line alignment of drawbar and bearing block is substantially maintained.

Figure 3:
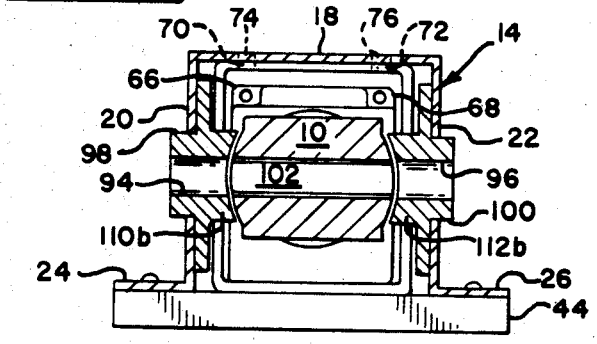
FIG. 3 is a sectional end elevation of the apparatus taken at line 3—3 in FIG. 1.

According to the present invention, it is critical to limit the possible extent of lateral movement of the drawbar 10 along the draft key 80 and against the follower block 36. This is accomplished by two features. Foremost is the provision of spacer means on either the drawbar 10 or side castings 98, 100 which serve to position and hold the drawbar centrally between sides 20, 22 of the center sill 14, yet permit angling movement vertically and laterally and also permit roll movement. Confronting surfaces on the spacer means and the opposing sill side castings or drawbar sides, as the case may be, are concentrically shaped to permit the aforedescribed movements. A practical and preferable form of spacer means is shown in the FIGS. 1–3 is guide lugs, generally 110 and 112, extending inwardly from each of the side castings 98, 100 respectively, into loose contact with the drawbar 10. Preferably such guide lugs are located symetrically above and below the edges of key slots 94, 96 nearer the pocket casting 40. Thus, in FIGS. 1 and 3, it may be seen that there are upper guide lugs 110*a* and 112*a* and lower guide lugs 110*b* and 112*b* adjacent the respective slots 94, 96. Preferably, the guide lugs, generally 110, 112, are integrally formed with the sill side castings 98, 100 as shown in FIG. 3, however, they may be separately formed and attached by welding or the like (or with fasteners).

Secondly, the surfaces of the drawbar 10 contacted by the guide lugs are preferably shaped into compound curved surfaces substantially of spherical portions whose center is coincident with the radial center of convex end 30 to accommodate vertical and lateral angling and rotational motion; and the bearing surfaces of the lugs 110*a*, 110*b*, 112*a* and 112*b* are curved to a cylindrical shape having a central axis passing substantially through the radial center of convex end surface 30. That is, the surfaces of drawbar 10 at least in the areas surrounding the butt ends of the slot 90 (toward the convex end 30) are convex substantially spherical segments; and the mating surfaces of the lugs 110*a*, 110*b*, 112*a* and 112*b* are substantially concentric concave spherical portions. However, the lugs are open toward the sill end 12 to permit insertion of the drawbar 10.

Thus, it will be seen that the spacer means in the form of the lugs, generally 110, 112, hold the end of the drawbar 10 substantially centrally within the center sill by reason of the curved wear surfaces, and allow the drawbar to angle both horizontally and vertically and to roll within the design limits of the system.

Figure 4:
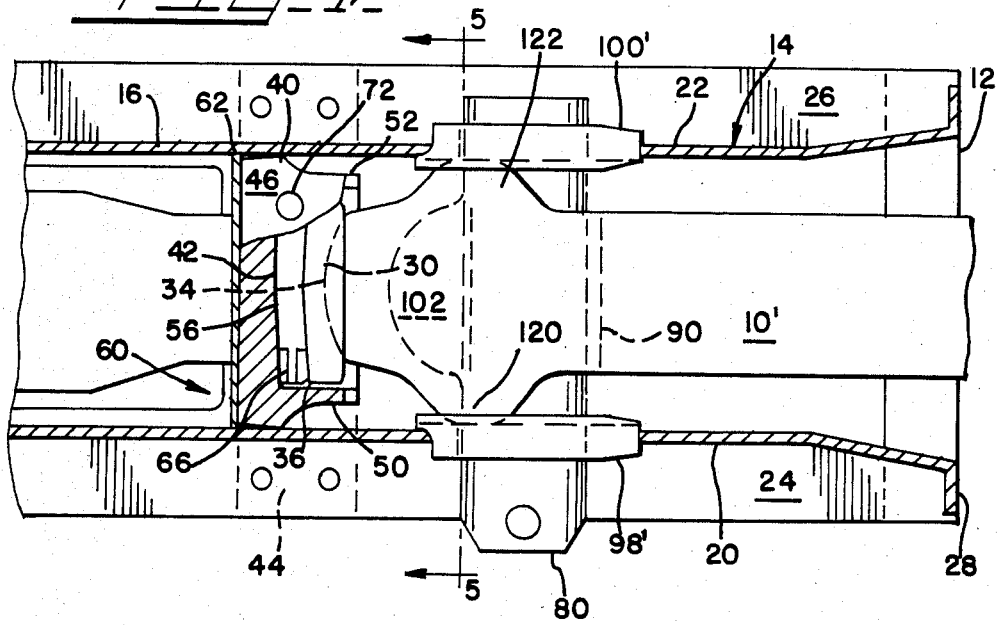
FIG. 4 is a plan view of a second embodiment of the invention.
Figure 5:
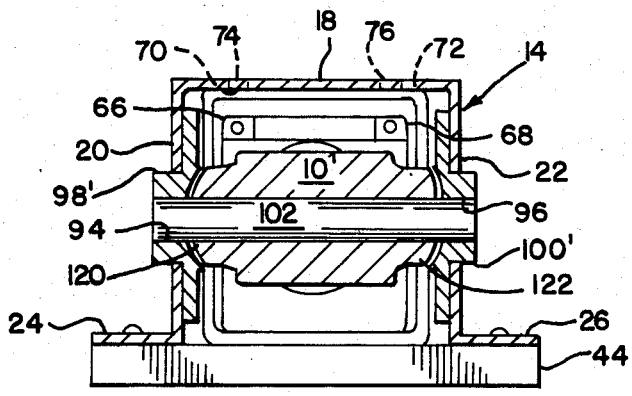
FIG. 5 is a sectional end elevation of the embodiment of FIG. 4 taken at line 5—5 therein.

In the embodiment of FIGS. 4 and 5 there are no lugs formed on the sill side castings 98′, and 100′, and the sides of the drawbar 10′ have protrusions 120, 122 extended outwardly and curved to form a spacer means which confront curved surfaces on the respective sill side castings.

Modifications and variations may be made in the aforedescribed invention without departing from the spirit and scope thereof which is defined hereafter in the claims.

What is claimed is:

1. In a slackless coupler connection for a railway car wherein a coupler member extends into a railcar center sill and a convex end of said coupler member abuts a concave follower block held against a wedge within said sill and a draft key extends horizontally through a slot in the coupler member shank and through slots in a pair of sill side castings secured to the center sill, the improvement comprising: spacer means on at least one of said pair of sill side castings and said coupler member to hold said coupler member evenly between said sill side castings, said spacer means and the other of said pair of sill side castings and said coupler member not provided with spacer means having confronting surfaces which surfaces are congruently curved whereby the coupler member may be vertically and laterally angled and may roll with respect to said sill side castings and the center sill.

2. The apparatus of claim 1 wherein the spacer means comprises guide lugs on each of the sill side castings.

3. The apparatus of claim 1 wherein the spacer means comprises a pair of concave guide lugs on each of the sill side castings, said guide lugs being located above and below the draft key slots in said sill side castings at the edge thereof positioned toward the said wedge and wherein the coupler member is a drawbar having convex sides adjacent the drawbar slot.

4. The apparatus of claim 1 wherein said wedge is retained in a pocket casting including ports in the said pocket casting to provide access whereby said wedge may be engaged and withdrawn from between said pocket casting and said follower block.

5. The apparatus of claim 4 wherein the ports are in the top of said pocket casting and the said wedge has lifting lugs aligned with said ports.

6. The apparatus of claim 5 including apertures in said center sill aligned with said ports.

7. The apparatus of claim 1 wherein the spacer means comprises protrusions on opposite side surfaces of said coupler member said protrusions located to engage each of said sill side castings.

8. An improved coupler member for a railway car said coupler having a shank with a draft key slot for installation in the center sill of a railway car, the improvement comprising: curved surfaces that are convex and of generally spherical portions which curved surfaces are positioned on opposite sides of said shank in areas adjacent the key slot therein.

9. In a slackless coupler connection for a railway car wherein a coupler member extends into a railcar center sill and a convex end of said coupler member abuts a concave follower block held against a wedge within said sill and a draft key extends horizontally through a slot in the coupler member shank and through slots in a pair of sill side castings secured to the center sill, the improvement comprising: spacer means on at least one of said pair of sill side castings and said coupler member to hold said coupler member evenly between said sill side castings, a pocket within said sill to retain said wedge against said follower block, said pocket casting including ports in the top thereof, and lifting lugs on said wedge aligned with said ports whereby said wedge may be engaged and withdrawn from between said pocket casting and said follower block.

10. The apparatus of claim 9 including apertures in said center sill aligned with said ports.

* * * * *